US010090075B2

(12) United States Patent
Ko et al.

(10) Patent No.: US 10,090,075 B2
(45) Date of Patent: Oct. 2, 2018

(54) DISPLAY DEVICE CONNECTED BY ANISOTROPIC CONDUCTIVE FILM

(71) Applicant: SAMSUNG SDI CO., LTD., Yongin-si, Gyeonggi-do (KR)

(72) Inventors: Youn Jo Ko, Suwon-si (KR); Kyoung Ku Kang, Suwon-si (KR); Soon Young Kwon, Suwon-si (KR); Ie Ju Kim, Suwon-si (KR); Hyun Joo Seo, Suwon-si (KR); Se Mi Heo, Suwon-si (KR)

(73) Assignee: SAMSUNG SDI CO., LTD., Yongin-si, Gyeonggi-do (KR)

( * ) Notice: Subject to any disclaimer, the term of this patent is extended or adjusted under 35 U.S.C. 154(b) by 255 days.

(21) Appl. No.: 14/947,909

(22) Filed: Nov. 20, 2015

(65) Prior Publication Data

US 2016/0148716 A1 May 26, 2016

(30) Foreign Application Priority Data

Nov. 20, 2014 (KR) ..... 10-2014-0162428

(51) Int. Cl.
*H01B 1/20* (2006.01)

(52) U.S. Cl.
CPC ..... *H01B 1/20* (2013.01)

(58) Field of Classification Search
None
See application file for complete search history.

(56) References Cited

U.S. PATENT DOCUMENTS

| | | | | |
|---|---|---|---|---|
| 8,163,835 | B2 * | 4/2012 | Park | C09J 4/00 439/91 |
| 2009/0078747 | A1 * | 3/2009 | Park | C09J 4/00 228/249 |

FOREIGN PATENT DOCUMENTS

| | | | |
|---|---|---|---|
| CN | 101392154 | A | 3/2009 |
| CN | 103155050 | A | 6/2013 |
| CN | 103965793 | A | 8/2014 |
| JP | 2012-097226 | A | 5/2012 |
| KR | 10-0673778 | B | 1/2007 |
| KR | 10-2012-0061950 | | 6/2012 |
| KR | 10-2012-01122943 | | 11/2012 |
| TW | 201229115 | A1 | 7/2012 |
| TW | 201437310 | A | 10/2014 |

OTHER PUBLICATIONS

Taiwanese Office Action dated May 19, 2016 in Corresponding Taiwanese Patent Application No. 104138160.
Chinese Office Action dated Jan. 25, 2018 in the corresponding Chinese Patent Application No. 201510802177.8.

* cited by examiner

*Primary Examiner* — Sheeba Ahmed
(74) *Attorney, Agent, or Firm* — Lee & Morse, P.C.

(57) ABSTRACT

A display device connected by an anisotropic conductive film, wherein the anisotropic conductive film includes conductive particles and has a minimum melt viscosity of 900 Pa·s to 90,000 Pa·s at 80° C. to 140° C.

18 Claims, 2 Drawing Sheets

【Fig. 1】
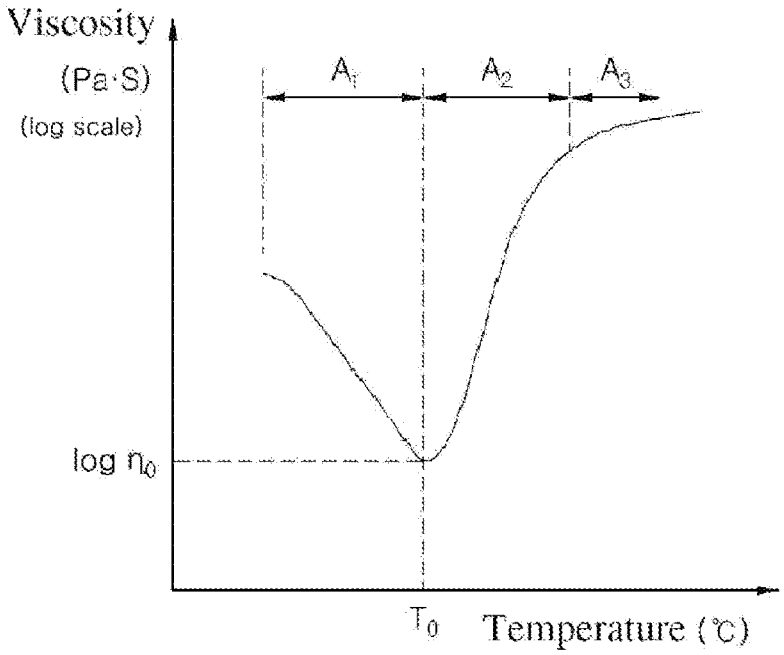
【Fig. 2】
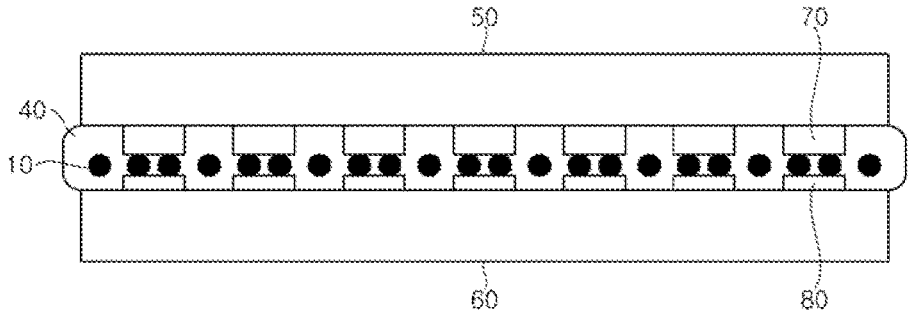

【Fig. 3】
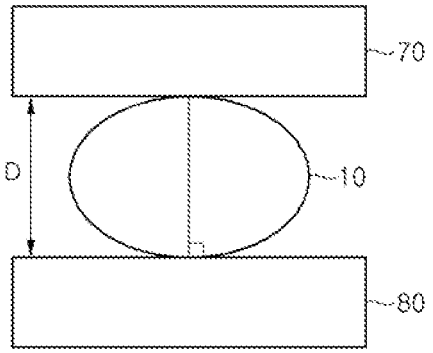

DISPLAY DEVICE CONNECTED BY ANISOTROPIC CONDUCTIVE FILM

CROSS-REFERENCE TO RELATED APPLICATION

Korean Patent Application No. 10-2014-0162428, filed on Nov. 20, 2014, in the Korean Intellectual Property Office, and entitled: "Display Device Connected by Anisotropic Conductive Film," is incorporated by reference herein in its entirety.

FIELD

Embodiments relate to a display device connected by an anisotropic conductive film.

DESCRIPTION OF THE RELATED ART

Anisotropic conductive films (ACFs) refer to film-shaped adhesives prepared by dispersing conductive particles in a resin such as an epoxy resin. An anisotropic conductive film may be composed of polymer layers having electric anisotropy and adhesion, and may exhibit conductive properties in the thickness direction of the film and insulating properties in the surface direction thereof.

When an anisotropic conductive film disposed between circuit boards to be connected is subjected to heating and compression under certain conditions, circuit terminals of the circuit boards are electrically connected through conductive particles and an insulating adhesive resin fills spaces between adjacent electrodes to isolate the conductive particles from each other, thereby providing high insulation performance.

SUMMARY

Embodiments are directed to a display device connected by an anisotropic conductive film The embodiments may be realized by providing a display device connected by an anisotropic conductive film, wherein the anisotropic conductive film includes conductive particles and has a minimum melt viscosity of 900 Pa·s to 90,000 Pa·s at 80° C. to 140° C.

The anisotropic conductive film may be prepared from a composition that includes 1 wt % to 25 wt % of a radical polymerizable material having a molecular weight of 500 g/mol or less, in terms of solid content.

The radical polymerizable material may include 4-hydroxybutyl (meth)acrylate, dimethyloltricyclodecane di(meth)acrylate, or pentaerythritol tri(meth)acrylate.

The radical polymerizable material may include 30 parts by weight to 50 parts by weight of 4-hydroxybutyl (meth) acrylate; 20 parts by weight to 40 parts by weight of dimethyloltricyclodecane di(meth)acrylate; and 10 parts by weight to 30 parts by weight of pentaerythritol tri(meth) acrylate, based on 100 parts by weight of the radical polymerizable material.

The anisotropic conductive film may have a connection resistance of 3Ω or less, as measured after preliminary compression at 50° C. to 90° C. under a load of 1 MPa to 5 MPa for 1 to 5 seconds and main compression at 130° C. to 200° C. under a load of 1 MPa to 5 MPa for 3 to 20 seconds.

The anisotropic conductive film may have a connection resistance of 15Ω or less as measured after the anisotropic conductive film is left at 85° C. and 85% RH for 500 hours subsequent to the preliminary compression and the main compression.

The anisotropic conductive film may have a conductive particle compression rate of 20% to 70%, as represented by Equation 1:

$$\text{Conductive particle compression rate (\%)}=[(C_1-C_2)/C_1]\times 100$$

where $C_1$ is a particle diameter in μm of conductive particles before compression, and $C_2$ is a particle diameter in μm of the conductive particles after preliminary compression at 50° C. to 90° C. under a load of 1 MPa to 5 MPa for 1 to 5 seconds and main compression at 130° C. to 200° C. under a load of 1 MPa to 5 MPa for 3 to 20 seconds.

The anisotropic conductive film may have a bubble area of 20% or less in a space between electrodes, as measured after the anisotropic conductive film is left at 85° C. and 85% RH for 500 hours subsequent to preliminary compression at 50° C. to 90° C. under a load of 1 MPa to 5 MPa for 1 to 5 seconds and main compression at 130° C. to 200° C. under a load of 1 MPa to 5 MPa for 3 to 20 seconds.

The embodiments may be realized by providing a display device connected by an anisotropic conductive film, wherein the anisotropic conductive film is prepared from a composition that includes a polymer resin; a radical polymerizable material having a molecular weight of 500 g/mol or less; a radical polymerization initiator; and conductive particles, wherein the radical polymerizable material is present in the anisotropic conductive film composition in an amount of 1 wt % to 25 wt %, in terms of solid content.

The radical polymerizable material comprises at least one selected from the group consisting of 4-hydroxybutyl (meth) acrylate, dimethyloltricyclodecane di(meth)acrylate, and pentaerythritol tri(meth)acrylate.

The radical polymerizable material may include 30 parts by weight to 50 parts by weight of 4-hydroxybutyl (meth) acrylate; 20 parts by weight to 40 parts by weight of dimethyloltricyclodecane di(meth)acrylate; and 10 parts by weight to 30 parts by weight of pentaerythritol tri(meth) acrylate, based on 100 parts by weight of the radical polymerizable material.

A weight ratio of the radical polymerizable material having a molecular weight of 500 g/mol or less to the polymer resin may be 1:2 to 1:9.

The polymer resin may include a first polymer resin having a weight average molecular weight of 5,000 g/mol to 40,000 g/mol, and a second polymer resin having a weight average molecular weight of greater than 40,000 g/mol.

A weight ratio of the first polymer resin to the second polymer resin may be 3:1 to 1:2.

A weight ratio of the radical polymerizable material having a molecular weight of 500 g/mol or less to the first polymer resin having a weight average molecular weight of 5,000 g/mol to 40,000 g/mol may be 1:0.5 to 1:8.

The composition may include 50 wt % to 90 wt % of the polymer resin; 0.5 wt % to 10 wt % of the radical polymerization initiator; and 1 wt % to 20 wt % of the conductive particles, all wt % in terms of solid content.

The first polymer resin may be present in the anisotropic conductive film composition in an amount of 20 wt % to 70 wt %, and the second polymer resin may be present in the anisotropic conductive film composition in an amount of 10 wt % to 60 wt %, all wt % in terms of solid content.

The anisotropic conductive film may further include insulating particles.

The insulating particles may be present in the anisotropic conductive film composition in an amount of 0.1 wt % to 20 wt %, in terms of solid content.

The embodiments may be realized by providing an anisotropic conductive film including a polymer resin; a radical polymerizable material having a molecular weight of 500 g/mol or less; a radical polymerization initiator; and conductive particles, wherein the radical polymerizable material is present in the anisotropic conductive film composition in an amount of 1 wt % to 25 wt %, based on a total weight of the composition.

BRIEF DESCRIPTION OF THE DRAWINGS

Features will be apparent to those of skill in the art by describing in detail exemplary embodiments with reference to the attached drawings in which:

FIG. 1 illustrates a conceptual view of a minimum melt viscosity for log scale of an anisotropic conductive film according to one embodiment, and a method for measuring minimum melt viscosity of an anisotropic conductive film.

FIG. 2 illustrates a sectional view of a display device according to an embodiment.

FIG. 3 illustrates a schematic view showing a method for measuring compression rate of conductive particles included in the anisotropic conductive film according to an embodiment.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. In addition, it will also be understood that when a layer is referred to as being "between" two layers, it can be the only layer between the two layers, or one or more intervening layers may also be present. Like reference numerals refer to like elements throughout.

Hereinafter, embodiments of the present invention will be described in detail. Description of details apparent to those skilled in the art may be omitted for clarity.

One embodiment relates to a display device connected by an anisotropic conductive film which has a minimum melt viscosity of 900 Pa·s to 90,000 Pa·s at 80° C. to 140° C., as measured using an ARES rheometer.

When an adhesive is heated, in an initial stage ($A_1$ zone), viscosity for log scale of the adhesive gradually decreases due to increase in temperature, and when a certain temperature ($T_0$) is reached, the adhesive melts and exhibits minimum viscosity for log scale (log $\eta_0$). Thereafter, when the adhesive is further heated, the adhesive undergoes curing ($A_2$ zone) and gradually increases in viscosity for log scale, and when the adhesive is completely cured ($A_3$ zone), the adhesive has a substantially constant viscosity for log scale. A $\eta_0$ value in log $\eta_0$ at the temperature $T_0$ is defined as "minimum melt viscosity" (See FIG. 1).

As used herein, the term "minimum melt viscosity at 80° C. to 140° C., as measured using an ARES rheometer" refers to the minimum melt viscosity value among melt viscosity values of the film at 80° C. to 140° C., as measured using an advanced rheometric expansion system (ARES) rheometer, e.g., a separate motor transducer (SMT) rheometer.

In an implementation, the anisotropic conductive film according to an embodiment may have a minimum melt viscosity at 80° C. to 140° C. of 900 Pa·s to 90,000 Pa·s, e.g. 1,000 Pa·s to 80,000 Pa·s or 1,500 Pa·s to 50,000 Pa·s.

Within this range, through adjustment of minimum melt viscosity, the anisotropic conductive film may help increase a collection rate of conductive particles even when the film has a monolayer structure (without an additional layer), thereby securing sufficient electrical conductivity while guaranteeing flowability of the film to enhance insulation reliability. In addition, the anisotropic conductive film may facilitate sufficient compression of conductive particles between electrodes, thereby providing improvement in indentation properties and reduction in resistance.

The minimum melt viscosity of the anisotropic conductive film may be measured by a suitable method. By way of example, the minimum melt viscosity of the anisotropic conductive film at 80° C. to 140° C. may be measured on a 150 μm thick sample using an ARES G2 rheometer (TA Instruments) under conditions of a temperature elevation rate of 10° C./min and a frequency of 1 rad/second in a temperature zone from 30° C. to 200° C.

FIG. 2 illustrates a sectional view of a display device according to an embodiment. The display device according to an embodiment may include, e.g., a first connection member 50 including a first electrode 70; a second connection member 60 including a second electrode 80; and an anisotropic conductive film disposed therebetween to connect the first electrode 70 to the second electrode 80. The anisotropic conductive film may be an anisotropic conductive film according to one embodiment. When the anisotropic conductive film 40 is disposed and compressed between the first connection member 50 (with the first electrode 70 formed thereon) and the second connection member 60 (with the first electrode 80 formed thereon), the first electrode 70 may be electrically connected to the second electrode 80 through conductive particles.

In an implementation, the anisotropic conductive film may have a connection resistance of 3Ω or less, e.g., 1.5Ω or less or 1Ω or less, as measured after preliminary compression at 50° C. to 90° C. under a load of 1 MPa to 5 MPa for 1 to 5 seconds and main compression at 130° C. to 200° C. under a load of 1 MPa to 5 MPa for 3 to 20 seconds.

In an implementation, the anisotropic conductive film may have a reliability connection resistance of 15Ω or less as measured after the anisotropic conductive film is left at 85° C. and 85% RH for 500 hours subsequent to preliminary compression and primary compression under the above conditions. In an implementation, the anisotropic conductive film may have a reliability connection resistance of 10Ω or less, e.g., 8Ω or less or 5Ω or less.

Within this range, the anisotropic conductive film may maintain low connection resistance even under high temperature/high-humidity conditions, thereby improving connection reliability. A display device connected by the anisotropic conductive film having stable reliability resistance may be used for a long time even under high temperature and/or high-humidity conditions.

Connection resistance may be measured by a suitable method. By way of example, connection of a device by an anisotropic conductive film sample may be performed through preliminary compression under conditions of 60° C., 1 MPa and 1 second, and main compression under conditions of 160° C., 3 MPa and 6 seconds, thereby preparing 5 specimens per sample. Then, connection resistance of each specimen may be measured 5 times by a 4-point probe method (in accordance with ASTM F43-64T), followed by averaging the measured values. After the preliminary compression and the main compression, each specimen may be left at 85° C. and 85% RH for 500 hours, and then evaluated as to high temperature/high-humidity reliability. Then, reliability connection resistance of each specimen may be measured in the same manner as above, followed by averaging the measured values.

In an implementation, the anisotropic conductive film may have a conductive particle compression rate of 20% to 70%, e.g., 30% to 65% or 40% to 60%, as represented by the following Equation 1.

$$\text{Conductive particle compression rate (\%)}=[(C_1-C_2)/C_1]\times 100$$

In Equation 1, $C_1$ is a particle diameter of conductive particles before compression, and $C_2$ is a particle diameter of the conductive particles after preliminary compression under conditions of 50° C. to 90° C., 1 MPa to 5 MPa and 1 to 5 seconds and main compression under conditions of 130° C. to 200° C., 1 MPa to 5 MPa and 3 to 20 seconds.

Referring to FIG. 3, the particle diameter $C_2$ of the conductive particles after compression refers to a minimum distance D of a compressed particle 10 in a compression direction (perpendicular to a longitudinal direction of an electrode) after the particle is compressed between upper and lower electrodes 70, 80.

Within this range of the conductive particle compression rate, the conductive particles between the electrodes may be sufficiently compressed due to sufficient flowability of the anisotropic conductive film having a minimum melt viscosity of 900 Pa·s to 90,000 Pa·s at 80° C. to 140° C., thereby improving indentation characteristics and connection resistance.

The conductive particle compression rate may be measured by a suitable method. By way of example, the particle diameter of the conductive particles before compression may be measured using a microscope (BX51, Olympus Optical), and, after preliminary compression under conditions of 60° C., 1 MPa and 1 second, and main compression under conditions of 160° C., 3 MPa and 6 seconds, the minimum distance of the conductive particles in a direction in which the conductive particles are compressed between the electrodes may be measured and defined as the particle diameter of the conductive particles.

In an implementation, the anisotropic conductive film may have a ratio of bubble area in a space portion between electrodes to area of the space of 20% or less, as measured after preliminary compression under conditions of 50° C. to 90° C., 1 MPa to 5 MPa and 1 to 5 seconds and main compression under conditions of 130° C. to 200° C., 1 MPa to 5 MPa and 3 to 20 seconds, and thus may exhibit good bubbling characteristics.

Within this range of the ratio of bubble area, the anisotropic conductive film may help suppress initial bubbling at a site of the film attached to a substrate and may help inhibit an increase in bubble area in the space, e.g., space portion, between the electrodes after the film is left under high temperature/high humidity conditions for a long time, thereby exhibiting excellent reliability properties such as connection resistance while allowing long term use of a display device using the anisotropic conductive film.

The bubble area in the space between the electrodes may be measured by a suitable method. By way of example, after a sample for measurement of bubble area is left at 85° C. and 85% RH for 500 hours subsequent to preliminary compression under conditions of 60° C., 1 MPa and 1 second, and main compression under conditions of 160° C., 3 MPa and 6 seconds, a space between electrodes filled with an anisotropic conductive film composition may be observed (or photographed) using a microscope, followed by calculating a bubble area in the space using an image analyzer or a calibrated grid sheet.

In an implementation, the anisotropic conductive film may have a clear indentation after preliminary compression under conditions of 50° C. to 90° C., 1 MPa to 5 MPa and 1 to 5 seconds and main compression under conditions of 130° C. to 200° C., 1 MPa to 5 MPa and 3 to 20 seconds.

As used herein, the term "indentation" refers to an indentation formed in a portion of the anisotropic conductive film corresponding to a space between terminals of a material to be bonded (hereinafter "space between terminals"), wherein the portion is actually attached to and compressed against the material during bonding of the film. Such an indentation serves as a measure of whether pressure applied to the anisotropic conductive film is uniformly distributed during compression of the film. Thus, whether the anisotropic conductive film is sufficiently attached to a substrate and thus whether a related display device is sufficiently connected may be determined through observation of the indentation.

Observation of the indentation may be performed by a suitable method. By way of example, after preliminary compression under conditions of 60° C., 1 MPa and 1 second, and main compression under conditions of 160° C., 3 MPa and 6 seconds, a space between terminals filled with an anisotropic conductive film composition may be observed using a microscope, thereby determining whether the film has a clear indentation.

The anisotropic conductive film may have a clear indentation after bonding, and thus may provide a display device having improved connection reliability.

Another embodiment relates to an anisotropic conductive film which may include a polymer resin, a radical polymerizable material having a molecular weight of 500 g/mol or less, a radical polymerization initiator, and conductive particles.

Components of a composition for anisotropic conductive films according to this embodiment will be described in detail. Amount of each component may be shown in the anisotropic conductive film composition in terms of solid content. In preparation of the anisotropic conductive film, the components may be dissolved in an organic solvent to obtain a liquid composition, followed by coating the composition onto a release film and drying for a sufficient time to volatilize the organic solvent, the solid content of the anisotropic conductive film may still contain the components of the anisotropic conductive film composition.

Radical polymerizable material having a molecular weight of 500 g/mol or less

The radical polymerizable material may have a molecular weight of 500 g/mol or less. For example, the radical polymerizable material may have a molecular weight of 400 g/mol or less.

Examples of the radical polymerizable material may include methyl (meth)acrylate, ethyl (meth)acrylate, n-butyl (meth)acrylate, isobutyl (meth)acrylate, t-butyl (meth)acrylate, 2-ethylhexyl (meth)acrylate, isodecyl (meth)acrylate, n-lauryl (meth)acrylate, $C_{12}$-$C_{15}$ alkyl (meth)acrylate, n-stearyl (meth)acrylate, n-butoxyethyl (meth)acrylate, butoxydiethylene glycol (meth)acrylate, methoxytriethylene glycol (meth)acrylate, cyclohexyl (meth)acrylate, tetrahydrofurfuryl (meth)acrylate, benzyl (meth)acrylate, 2-phenoxyethyl (meth)acrylate, isobornyl (meth)acrylate, 2-hydroxyethyl (meth)acrylate, 2-hydroxypropyl (meth)acrylate, 2-hydroxybutyl (meth)acrylate, 4-hydroxybutyl (meth)acrylate, dimethylaminoethyl (meth)acrylate, diethylaminoethyl (meth)acrylate, (meth)acrylic acid, 2-(meth)acryloyloxyethyl succinic acid, 2-(meth)acryloyloxyethyl hexahydrophthalate, 2-(meth)acryloyloxyethyl-2-hydroxypropylphthalate, glycidyl (meth)acrylate, 2-(meth) acryloyloxyethyl acid phosphate, ethylene glycol di(meth) acrylate, diethylene glycol di(meth)acrylate, triethylene glycol di(meth)acrylate, 1,4-butanediol di(meth)acrylate, neopentyl glycol di(meth)acrylate, 1,6-hexanediol di(meth) acrylate, 1,9-nonanediol di(meth)acrylate, 1,10-decanediol di(meth)acrylate, glycerine di(meth)acrylate, 2-hydroxy-3-acryloyloxy propyl(meth)acrylate, dimethyloltricyclodecane di(meth)acrylate, trifluoroethyl (meth)acrylate, perfluorooctylethyl (meth)acrylate, isoamyl acrylate, lauroyl acrylate, di(meth)acrylate of bisphenol A ethylene oxide, bisphenol A diglycidyl di(meth)acrylate, trimethylolpropane tri(meth)acrylate, pentaerythritol tri(meth)acrylate, and the like. These may be used alone or in combination thereof.

In an implementation, the radical polymerizable material may include at least one of, e.g., 4-hydroxybutyl (meth) acrylate, dimethyloltricyclodecane di(meth)acrylate, and/or pentaerythritol tri(meth)acrylate.

In an implementation, the radical polymerizable material having a molecular weight of 500 g/mol or less may be present in the anisotropic conductive film composition in an amount of 1 wt % to 25 wt %, e.g., 5 wt % to 25 wt % or 5 wt % to 23 wt %, in terms of solid content. Within this content range of the radical polymerizable material having a molecular weight of 500 g/mol or less, it is possible to secure both electrical conductivity and insulation properties through adjustment of minimum melt viscosity of the anisotropic conductive film even when the film has a monolayer structure and to help prevent a cured product of the film from having excessive hardness, thereby preventing formation of a mass of bubbles.

In an implementation, the radical polymerizable material may include all of 4-hydroxybutyl (meth)acrylate, dimethyloltricyclodecane di(meth)acrylate, and pentaerythritol tri (meth)acrylate. In this case, 4-hydroxybutyl (meth)acrylate, dimethyloltricyclodecane di(meth)acrylate, and pentaerythritol tri(meth)acrylate may be present in amounts of 30 parts by weight to 50 parts by weight, 20 parts by weight to 40 parts by weight, and 10 parts by weight to 30 parts by weight, respectively, based on 100 parts by weight of the radical polymerizable material having a molecular weight of 500 g/mol or less.

In an implementation, the anisotropic conductive film may further include a polymer resin. A weight ratio of the radical polymerizable material having a molecular weight of 500 g/mol or less to the polymer resin may be 1:2 to 1:9, e.g., 1:3 to 1:8.5.

Within this range, the anisotropic conductive film may facilitate adjustment of flowability thereof and may exhibit appropriate minimum melt viscosity, thereby securing both electrical conductivity and insulation properties even when the film has a monolayer structure.

Next, the polymer resin will be described in detail.

Polymer Resin

The polymer resin may include a suitable polymer resin.

In an implementation, the polymer resin may include, in terms of molecular weight, e.g., a first polymer resin having a weight average molecular weight of 5,000 g/mol to 40,000 g/mol and a second polymer resin having a weight average molecular weight of greater than 40,000 g/mol. A weight ratio of the first polymer resin to the second polymer resin may be 3:1 to 1:2, e.g., 3:1 to 1:1.5.

The polymer resin may be present in the anisotropic conductive film composition in an amount of 50 wt % to 90 wt %, in terms of solid content.

In an implementation, the first polymer resin may be present in the anisotropic conductive film composition in an amount of 20 wt % to 70 wt %, e.g., 20 wt % to 60 wt %, and the second polymer resin may be present in the anisotropic conductive film composition in an amount of 10 wt % to 60 wt %, e.g., 10 wt % to 50 wt %, in terms of solid content.

In an implementation, a weight ratio of the radical polymerizable material having a molecular weight of 500 g/mol or less to the first polymer resin having a molecular weight of 5,000 g/mol to 40,000 g/mol may be 1:0.5 to 1:8, e.g., 1:1 to 1:6.

Within this range of the weight ratio of the radical polymerizable material to the first polymer resin, the anisotropic conductive film may secure sufficient flowability while improving electrical conductivity even when the film has a monolayer structure.

One example of the first polymer resin may include thermosetting resins, e.g., a urea resin, a melamine resin, a phenol resin, an unsaturated polyester resin, a polyurethane resin, and the like. These may be used alone or in combination thereof.

In an implementation, as the first polymer resin, a polyurethane resin having a molecular weight of 5,000 g/mol to 40,000 g/mol may be used.

One example of the second polymer resin may include a polyurethane resin having a weight average molecular weight of greater than 40,000 g/mol or a thermoplastic resin having a weight average molecular weight of greater than 40,000 g/mol. Examples of the thermoplastic resin having a weight average molecular weight of greater than 40,000 g/mol may include olefin resins such as polyethylene or polypropylene resins, butadiene resins, epoxy resins, phenoxy resins, polyamide resins, polyimide resins, polyester resins, silicone resins, acrylonitrile resins, polyvinyl butyral resins, ethylene-vinyl acetate copolymers, and acrylic copolymers. These may be used alone or in combination thereof. In an implementation, the second polymer resin may include both a polyurethane resin having a weight average molecular weight of greater than 40,000 g/mol and a thermoplastic resin having a weight average molecular weight of greater than 40,000 g/mol.

In an implementation, the second polymer resin may include a butadiene resin and an acrylic copolymer.

Examples of the butadiene resin may include acrylonitrile-butadiene copolymers, styrene-butadiene copolymers, (meth)acrylate-butadiene copolymers, (meth)acrylate-acrylonitrile-butadiene-styrene copolymers, and carboxyl group-modified acrylonitrile-butadiene copolymers, and the like. Examples of the acrylic copolymers may include acryl copolymers obtained by polymerization of acrylic monomers such as ethyl, methyl, propyl, butyl, hexyl, oxyl, dodecyl, lauroyl acrylates, methacrylates, acrylates obtained by modification thereof, acrylic acid, methacrylic acid, methyl methacrylate, vinyl acetate, and acrylic monomers obtained by modification thereof.

Radical Polymerization Initiator

The radical polymerization initiator may include an organic peroxide, which functions as a curing agent generating free radicals by heat or light.

The organic peroxide may include, e.g., t-butyl peroxy laurate, 1,1,3,3-t-methylbutylperoxy-2-ethylhexanoate, 2,5-dimethyl-2,5-di(2-ethylhexanoylperoxy)hexane, 1-cyclohexyl-1-methylethylperoxy-2-ethylhexanoate, 2,5-dimethyl-2,5-di(m-toluoylperoxy)hexane, t-butyl peroxy isopropyl monocarbonate, t-butyl peroxy-2-ethylhexyl monocarbonate, t-hexyl peroxy benzoate, t-butyl peroxy acetate, dicumyl peroxide, 2,5,-dimethyl-2,5-di(t-butyl peroxy) hexane, t-butyl cumyl peroxide, t-hexyl peroxy neodecanoate, t-hexyl peroxy-2-ethyl hexanoate, t-butyl peroxy-2-2-ethylhexanoate, t-butyl peroxy isobutyrate, 1,1-bis (t-butyl peroxy)cyclohexane, t-hexyl peroxyisopropyl monocarbonate, t-butyl peroxy-3,5,5-trimethyl hexanoate, t-butyl peroxy pivalate, cumyl peroxy neodecanoate, di-isopropyl benzene hydroperoxide, cumene hydroperoxide, isobutyl peroxide, 2,4-dichloro benzoyl peroxide, 3,5,5-trimethyl hexanoyl peroxide, octanoyl peroxide, lauroyl peroxide, stearoyl peroxide, succinic acid peroxide, benzoyl peroxide, 3,5,5-trimethyl hexanoyl peroxide, benzoyl peroxy toluene, 1,1,3,3-tetramethyl butyl peroxy neodecanoate, 1-cyclohexyl-1-methylethyl peroxy neodecanoate, di-n-propyl peroxy dicarbonate, di-isopropyl peroxy carbonate, bis (4-t-butyl cyclohexyl) peroxy dicarbonate, di-2-ethoxy methoxy peroxy dicarbonate, di(2-ethyl hexyl peroxy) dicarbonate, dimethoxy butyl peroxy dicarbonate, di(3-methyl-3-methoxy butyl peroxy) dicarbonate, 1,1-bis(t-hexyl peroxy)-3,3,5-trimethylcyclohexane, 1,1-bis(t-hexyl peroxy) cyclohexane, 1,1-bis(t-butyl peroxy)-3,3,5-trimethylcyclohexane, 1,1-(t-butyl peroxy)cyclododecane, 2,2-bis(t-butyl peroxy)decane, t-butyl trimethyl silyl peroxide, bis(t-butyl) dimethyl silyl peroxide, t-butyl triallyl silyl peroxide, bis(t-butyl) diallyl silyl peroxide, tris(t-butyl)allyl silyl peroxide, or the like.

In an implementation, the radical polymerization initiator may include, e.g., lauroyl peroxide, benzoyl peroxide, or isobutyl peroxide.

The radical polymerization initiator may be present in the anisotropic conductive film composition in an amount of 0.5 wt % to 10 wt %, specifically 1 wt % to 10 wt %, more specifically, 1 wt % to 5 wt %, in terms of solid content.

Within this range, the anisotropic conductive film may exhibit good balance between curability and preservability required for an adhesive.

Conductive Particles

The conductive particles may include suitable conductive particles.

Examples of the conductive particles may include: metal particles such as Au, Ag, Ni, Cu, and solder particles; carbon particles; polymer particles obtained by coating a polymer resin, such as polyethylene, polypropylene, polyester, polystyrene, and polyvinyl alcohol, or a modification thereof, with a metal such as Au, Ag, and Ni; and particles obtained through insulation treatment of surfaces of the polymer particles with insulating particles. These may be used alone or in combination thereof.

An average particle diameter of the conductive particles may vary depending upon a pitch of a circuit to be used. In an implementation, the conductive particles may have an average particle diameter of 1 μm to 50 μm depending on applications thereof. In an implementation, the conductive particles may have an average particle diameter of 3 μm to 20 μm.

The conductive particles may be present in the anisotropic conductive film composition in an amount of 1 wt % to 20 wt %, specifically 1 wt % to 15 wt %, more specifically 1 wt % to 10 wt %, in terms of solid content.

Within this content range, the anisotropic conductive film may help secure stable connection reliability while exhibiting low connection resistance.

In an implementation anisotropic conductive film may further include insulating particles in addition to the above components.

Insulating Particles

The insulating particles may include, e.g., inorganic particles, organic particles, or organic/inorganic composite particles. The inorganic particles may include at least one of silica ($SiO_2$), $Al_2O_3$, $TiO_2$, ZnO, MgO, $ZrO_2$, PbO, $Bi_2O_3$, $MoO_3$, $V_2O_5$, $Nb_2O_5$, $Ta_2O_5$, $WO_3$ and $In_2O_3$; the organic particles may include acrylic beads; and the organic/inorganic composite particles may be inorganic particles coated with organic materials.

In an implementation, the insulating particles may be inorganic particles, e.g., titanium oxide ($TiO_2$) or silica. The silica may include silica prepared by a liquid phase process such as sol-gel processing and sedimentation; silica prepared by a vapor phase process such as flame oxidation; non-powdery silica obtained from silica gel without pulverization; fumed silica; and/or fused silica. The silica particles may have a spherical shape, a fragment shape, an edgeless shape, and the like. The fused silica may include at least one of natural silica glass prepared by melting natural crystal or quartz with arc (flame) discharge or oxyhydrogen flame and synthesized silica glass obtained by pyrolysis of gaseous materials such as silicon tetrachloride or silane using oxyhydrogen flame or oxygen plasma.

When the insulating particles have a greater size (average particle diameter) than the conductive particles, the anisotropic conductive film may have poor electrical conductivity. In an implementation, the insulating particles may have a smaller size than the conductive particles. In an implementation, the insulating particles may have an average particle diameter of 0.1 μm to 20 μm or 1 μm to 10 μm depending on applications thereof.

The insulating particles may be present in the anisotropic conductive film composition in an amount of 0.1 wt % to 20 wt %, e.g., 0.1 wt % to 10 wt % or 0.1 wt % to 5 wt %, in terms of solid content.

Within this range, the insulating particles may help provide insulation properties to the anisotropic conductive film and may allow the anisotropic conductive film to have high connection reliability.

A suitable apparatus or equipment may be to form the anisotropic conductive film using the anisotropic conductive film composition according to this embodiment. For example, the polymer resin may be dissolved in an organic solvent to be liquefied, and the other components are added thereto, followed by stirring for a sufficient time, thereby preparing an anisotropic conductive film composition. Then, the composition may be applied to a release film to a thickness of 10 μm to 50 μm, followed by drying for a sufficient time to volatilize the organic solvent, thereby obtaining an anisotropic conductive film having a monolayer structure.

In an implementation, the organic solvent may include a suitable organic solvent.

An embodiment may provide a display device connected by one of the anisotropic conductive films as set forth above. For example, the display device may include a first connection member including a first electrode; a second connection member including a second electrode; and an anisotropic conductive film disposed between the first connection member and the second connection member and connecting the first electrode to the second electrode, wherein the anisotropic conductive film is an anisotropic conductive film according to one embodiment. A wiring board and a semiconductor chip may include suitable ones thereof.

In an implementation, the display device according to this embodiment may be fabricated by a suitable method.

Next, the present invention will be described in more detail with reference to some examples. However, it should be understood that these examples are provided for illustration only and are not to be construed in any way as limiting the present invention.

The following Examples and Comparative Examples are provided in order to highlight characteristics of one or more embodiments, but it will be understood that the Examples and Comparative Examples are not to be construed as limiting the scope of the embodiments, nor are the Comparative Examples to be construed as being outside the scope of the embodiments. Further, it will be understood that the embodiments are not limited to the particular details described in the Examples and Comparative Examples.

EXAMPLES AND COMPARATIVE EXAMPLES

Details of components used in preparation of anisotropic conductive film compositions are shown in Table 1.

TABLE 1

| | | Example | | | | Comparative Example | |
|---|---|---|---|---|---|---|---|
| Unit (wt %) | | 1 | 2 | 3 | 4 | 1 | 2 |
| Radical polymerizable material having a molecular weight of 500 g/mol or less | | 20 | 20 | 20 | 10 | 30 | |
| Radical polymerizable material having a molecular weight of greater than 500 g/mol | | — | — | — | — | | 20 |
| Polymer resin | First polymer resin | 50 | 45 | 30 | 50 | 40 | 50 |
| | Second polymer resin | 23 | 23 | 43 | 33 | 23 | 23 |
| Radical polymerization initiator | | 3 | 3 | 3 | 3 | 3 | 3 |
| Conductive particles | | 4 | 4 | 4 | 4 | 4 | 4 |
| Insulating particles | | — | 5 | — | — | — | — |
| Total | | 100 | 100 | 100 | 100 | 100 | 100 |

Example 1

Preparation of First Polymer Resin and Second Polymer Resin Compositions

First polymer resin: A polyurethane resin having a weight average molecular weight of 30,000 g/mol.

Second polymer resin: A resin obtained by mixing 50 wt % of an NBR resin having a weight average molecular weight of 1,000,000 g/mol with 50 wt % of a polyurethane resin having a weight average molecular weight of 100,000 g/mol.

Preparation of Anisotropic Conductive Film Composition

The first polymer resin composition and the second polymer resin composition were mixed in amounts as listed in Table 1, followed by mixing a radical polymerizable material having a molecular weight of 500 g/mol or less therewith such that the radical polymerizable material was present in an amount of 20 wt % in the anisotropic conductive film composition in terms of solid content, wherein the radical polymerizable material was obtained by mixing 20 wt % of pentaerythritol tri(meth)acrylate (molecular weight: 340 g/mol); 40 wt % of dimethyloltricyclodecane diacrylate (molecular weight: 304 g/mol); and 40 wt % of 4-hydroxybutyl (meth)acrylate (molecular weight: 144 g/mol).

Then, the following components were added to the mixture in amounts as listed in Table 1, thereby preparing a final anisotropic conductive film composition.

1) Radical polymerization initiator: lauryl peroxide (Luperox LP, Aldrich Chemical)

2) Conductive particle: (NIEYB00475, Sekisui Chemical)

Preparation of Anisotropic Conductive Film

The anisotropic conductive film composition was subjected to stirring at room temperature (25° C.) for 60 min at a stirring rate not causing conductive particles to be pulverized. The composition was coated onto a polyethylene base film, the surface of which was subjected to release treatment with silicone, to a film thickness of 25 μm using a casting knife, followed by drying at 60° C. for 5 min, thereby preparing an anisotropic conductive film.

Example 2

An anisotropic conductive film was prepared in the same manner as in Example 1 except that 5 wt % of insulating particles (AEROSIL R812, EVONIK Co., Ltd.) were added as shown in Table 1.

Example 3

An anisotropic conductive film was prepared in the same manner as in Example 1 except that amounts of some of the components were changed as shown in Table 1.

Example 4

An anisotropic conductive film was prepared in the same manner as in Example 1 except that amounts of some of the components were changed as shown in Table 1.

Comparative Example 1

An anisotropic conductive film was prepared in the same manner as in Example 1 except that amounts of some of the components were changed as shown in Table 1.

Comparative Example 2

An anisotropic conductive film was prepared in the same manner as in Example 1 except that a radical polymerizable material having a molecular weight of greater than 500 g/mol was used instead of the radical polymerizable material having a molecular weight of 500 g/mol or less. As the radical polymerizable material having a molecular weight of greater than 500 g/mol, 20 wt % of propoxylated ethoxylated bis-A diacrylate (molecular weight: 1,296 g/mol) was used.

Experimental Example 1

Measurement of Minimum Melt Viscosity

Minimum melt viscosity at 80° C. to 140° C. of each of the anisotropic conductive films of Examples and Comparative Examples was measured on a sample prepared by stacking six 25 μm thick anisotropic conductive films one above another using an ARES G2 rheometer (TA Instruments) under conditions of a temperature elevation rate of 10° C./min and a frequency of 1 rad/second in a temperature zone from 30° C. to 200° C.

Experimental Example 2

Measurement of Initial Connection Resistance and Reliability Connection Resistance (1) Preparation of Specimen A glass substrate in which an indium tin oxide (ITO) circuit having an electrode area of 75,000 $\mu m^2$ and a thickness of 2,200 Å had a 1,000 Å thick chromium (Cr) layer deposited thereon, and an FPC having a bump area of 75,000 $\mu m^2$ and an electrode thickness of 12 μm were placed on upper and lower surfaces of each sample of the anisotropic conductive films prepared in the Examples and Comparative Examples, followed by compression and heating under the following conditions, thereby manufacturing 5 specimens per sample.

1) Preliminary compression conditions; 60° C., 1 sec, 1 MPa

2) Main compression conditions; 160° C., 6 sec, 3 MPa (2) Measurement of Initial Connection Resistance After completion of preliminary compression and main compression, connection resistance of each sample was measured 5 times by a 4-point probe method (in accordance with ASTM F43-64T), followed by averaging the measured values.

(3) Measurement of Reliability Connection Resistance

After measurement of initial connection resistance, each sample was left in a high-temperature/high-humidity chamber at 85° C. and 85% RH for 500 hours, followed by measuring connection resistance in the same manner as above and averaging the measured values.

Experimental Example 3

Measurement of Conductive Particle Compression Rate

Conductive particle compression rate of each of the anisotropic conductive films prepared in the Examples and Comparative Examples was measured as follows:

Particle diameter of conductive particles before compression was measured using a microscope (BX51, Olympus Optical), and specimens were prepared in the same manner as in preparation of the specimen for measurement of connection resistance. Then, a sectional specimen of a bonding site was prepared using an Ion Milling System (IM4000, Hitachi Co., Ltd.), followed by measurement of particle diameter of conductive particles between electrodes and calculating conductive particle compression rate according to Equation 1:

$$\text{Conductive particle compression rate (\%)}=[(C_1-C_2)/C_1]\times 100$$

where $C_1$ is the particle diameter in μm of conductive particles before compression, and $C_2$ is the particle diameter in μm of the conductive particles after preliminary compression and main compression under conditions as set forth above.

Experimental Example 4

Evaluation of Bubbling

To evaluate bubbling properties of the anisotropic conductive films prepared in the Examples and Comparative Examples, testing was performed as follows.

Specimens were prepared in the same manner as in preparation of the specimen for measurement of connection resistance and left in a high-temperature/high-humidity chamber at 85° C. and 85% RH for 500 hours, followed by observing (or photographing) a space portion between electrodes filled with the film composition using a microscope and calculating the bubble area in the space portion using an image analyzer or a calibrated grid sheet.

A bubble area of 20% or less was rated as O, a bubble area of greater than 20% to 60% was rated as Δ; and a bubble area of greater than 60% was rated as X.

Experimental Example 5

Evaluation of Indentation

To evaluate indentation properties of the anisotropic conductive films prepared in the Examples and Comparative Examples, testing was performed as follows:

A specimen was prepared using each of the anisotropic conductive films prepared in the Examples and Comparative Examples in the same manner as in preparation of the specimen for measurement of connection resistance. Then, an indentation formed at a chromium electrode site was observed through a rear surface of a glass substrate using an optical microscope (GX-41, Olympus Optical).

A clear indentation was rated as O and no indentation was rated as X.

Evaluation results in Experimental Examples 1 to 5 are shown in Table 2.

TABLE 2

| | | Example | | | | Comparative Example | |
|---|---|---|---|---|---|---|---|
| | | 1 | 2 | 3 | 4 | 1 | 2 |
| Minimum melt viscosity (Pa · s) | | 2,000 | 4,000 | 30,000 | 25,000 | 800 | 130,000 |
| Connection resistance (Ω) | Initial connection resistance | 0.8 | 0.9 | 1.0 | 1.0 | 0.8 | 5.8 |
| | Reliability connection resistance | 2.2 | 2.0 | 2.1 | 2.0 | 12.3 | 7.5 |

TABLE 2-continued

| | Example | | | | Comparative Example | |
|---|---|---|---|---|---|---|
| | 1 | 2 | 3 | 4 | 1 | 2 |
| Conductive particle compression rate (%) | 60 | 60 | 58 | 59 | 62 | 15 |
| Bubbling | ○ | ○ | ○ | ○ | X | ○ |
| Indentation | ○ | ○ | ○ | ○ | ○ | X |

By way of summation and review, some monolayer anisotropic conductive films have had difficulty securing both connectivity and insulating properties. Accordingly, a multilayer anisotropic conductive film including two or more layers having different viscosities may be considered. Although such a multilayer anisotropic conductive film may have high particle collection rate, conductive particles between electrodes may not be sufficiently compressed due to poor flowability of an insulating resin between the electrodes and thus the distance between electrodes may be increased after curing the film, thereby causing deterioration in indentation properties and connection resistance.

The embodiments may provide an anisotropic conductive film having a monolayer structure, which achieves connectivity by conductive particles while improving flowability of the film to secure insulation properties through adjustment of minimum melt viscosity of the film.

The embodiments may provide an anisotropic conductive film which has excellent indentation properties and connection resistance and thus exhibits improved connection reliability, and a display device which is connected using the same and thus has a long lifespan.

The embodiments may provide a display device connected by an anisotropic conductive film which includes 1 wt % to 25 wt % of a radical polymerizable material having a molecular weight of 500 g/mol or less to adjust minimum melt viscosity of the film and thus may help secure both connectivity and insulation properties even when the film has a monolayer structure.

The embodiments may provide a display device connected by an anisotropic conductive film which has excellent indentation properties and connection resistance.

The embodiments may provide a display device which is connected by an anisotropic conductive film having excellent connection reliability and bubbling properties and thus has a long lifespan even under high temperature and/or high humidity conditions.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device connected by an anisotropic conductive film, wherein the anisotropic conductive film includes conductive particles and has a minimum melt viscosity of 900 Pa·s to 90,000 Pa·s at 80° C. to 140° C., the anisotropic conductive film is prepared from a composition that includes a radical polymerizable material having a molecular weight of 500 g/mol or less, the radical polymerizable material includes a tri (meth) acrylate, a di(meth)acrylate, and a mono(meth)acrylate, and the composition includes the radical polymerizable material in an amount of 1 wt % to 25 wt %, in terms of solid content.

2. The display device as claimed in claim 1, wherein the radical polymerizable material includes 4-hydroxybutyl (meth)acrylate, dimethyloltricyclodecane di(meth)acrylate, or pentaerythritol tri(meth)acrylate.

3. The display device as claimed in claim 1, wherein the radical polymerizable material includes:

30 parts by weight to 50 parts by weight of 4-hydroxybutyl (meth)acrylate;

20 parts by weight to 40 parts by weight of dimethyloltricyclodecane di(meth)acrylate; and 10 parts by weight to 30 parts by weight of pentaerythritol tri(meth)acrylate, based on 100 parts by weight of the radical polymerizable material.

4. The display device as claimed in claim 1, wherein the anisotropic conductive film has a connection resistance of 3Ω or less, as measured after preliminary compression at 50° C. to 90° C. under a load of 1 MPa to 5 MPa for 1 to 5 seconds and main compression at 130° C. to 200° C. under a load of 1 MPa to 5 MPa for 3 to 20 seconds.

5. The display device as claimed in claim 4, wherein the anisotropic conductive film has a connection resistance of 15Ω or less as measured after the anisotropic conductive film is left at 85° C. and 85% RH for 500 hours subsequent to the preliminary compression and the main compression.

6. The display device as claimed in claim 1, wherein the anisotropic conductive film has a conductive particle compression rate of 20% to 70%, as represented by Equation 1:

$$\text{Conductive particle compression rate (\%)}=[(C_1-C_2)/C_1]\times 100$$

where $C_1$ is a particle diameter in μm of conductive particles before compression, and $C_2$ is a particle diameter in μm of the conductive particles after preliminary compression at 50° C. to 90° C. under a load of 1 MPa to 5 MPa for 1 to 5 seconds and main compression at 130° C. to 200° C. under a load of 1 MPa to 5 MPa for 3 to 20 seconds.

7. The display device as claimed in claim 1, wherein the anisotropic conductive film has a bubble area of 20% or less in a space between electrodes, as measured after the anisotropic conductive film is left at 85° C. and 85% RH for 500 hours subsequent to preliminary compression at 50° C. to 90° C. under a load of 1 MPa to 5 MPa for 1 to 5 seconds and main compression at 130° C. to 200° C. under a load of 1 MPa to 5 MPa for 3 to 20 seconds.

8. A display device connected by an anisotropic conductive film, wherein the anisotropic conductive film is prepared from a composition that includes:

a polymer resin;

a radical polymerizable material having a molecular weight of 500 g/mol or less, the radical polymerizable material including a tri (meth)acrylate, a di(meth)acrylate, and a mono(meth)acrylate;

a radical polymerization initiator; and conductive particles, wherein the radical polymerizable material is present in the anisotropic conductive film composition in an amount of 1 wt % to 25 wt %, in terms of solid content, and wherein the polymer resin includes:

a first polymer resin having a weight average molecular weight of 5,000 g/mol to 40,000 g/mol, and a second polymer resin different from the first polymer resin and having a weight average molecular weight of greater than 40,000 g/mol.

9. The display device as claimed in claim 8, wherein the radical polymerizable material includes at least one of 4-hydroxybutyl (meth)acrylate, dimethyloltricyclodecane di(meth)acrylate, and pentaerythritol tri(meth)acrylate.

10. The display device as claimed in claim 8, wherein the radical polymerizable material includes:

30 parts by weight to 50 parts by weight of 4-hydroxybutyl (meth)acrylate;

20 parts by weight to 40 parts by weight of dimethyloltricyclodecane di(meth)acrylate; and 10 parts by weight to 30 parts by weight of pentaerythritol tri(meth)acrylate, based on 100 parts by weight of the radical polymerizable material.

11. The display device as claimed in claim 8, wherein a weight ratio of the radical polymerizable material having a molecular weight of 500 g/mol or less to the polymer resin is 1:2 to 1:9.

12. The display device as claimed in claim 8, wherein a weight ratio of the first polymer resin to the second polymer resin is 3:1 to 1:2.

13. The display device as claimed in claim 8, wherein a weight ratio of the radical polymerizable material having a molecular weight of 500 g/mol or less to the first polymer resin having a weight average molecular weight of 5,000 g/mol to 40,000 g/mol is 1:0.5 to 1:8.

14. The display device as claimed in claim 8, wherein the anisotropic conductive film composition includes:

50 wt % to 90 wt % of the polymer resin;

0.5 wt % to 10 wt % of the radical polymerization initiator; and 1 wt % to 20 wt % of the conductive particles, in the anisotropic conductive film composition in terms of solid content.

15. The display device as claimed in claim 8, wherein:

the first polymer resin is present in the anisotropic conductive film composition in an amount of 20 wt % to 70 wt %, and the second polymer resin is present in the anisotropic conductive film composition in an amount of 10 wt % to 60 wt %, all wt % in terms of solid content.

16. The display device as claimed in claim 8, wherein the anisotropic conductive film further includes insulating particles.

17. The display device as claimed in claim 16, wherein the insulating particles are present in the anisotropic conductive film composition in an amount of 0.1 wt % to 20 wt %, in terms of solid content.

18. An anisotropic conductive film, comprising:

a polymer resin;

a radical polymerizable material having a molecular weight of 500 g/mol or less, the radial polymerizable material including a tri (meth)acrylate, a di(meth)acrylate, and a mono(meth)acrylate;

a radical polymerization initiator; and conductive particles, wherein the radical polymerizable material is present in the anisotropic conductive film in an amount of 1 wt % to 25 wt %, based on a total weight of the composition.

* * * * *